United States Patent [19]

Gerber, Jr.

[11] Patent Number: 4,495,698

[45] Date of Patent: Jan. 29, 1985

[54] CONCAVE GRIND KNIFE BLADE AND METHOD OF MAKING

[75] Inventor: Joseph R. Gerber, Jr., Lake Oswego, Oreg.

[73] Assignee: Gerber Legendary Blades, Portland, Oreg.

[21] Appl. No.: 413,666

[22] Filed: Sep. 1, 1982

[51] Int. Cl.[3] ..... B26B 3/03; B21K 11/02

[52] U.S. Cl. ..... 30/357; 76/104 R

[58] Field of Search ..... 30/345.57, 346.59, 346.61, 30/351, 353, 355, 357, 138; 76/104 R, 82; D7/137

[56] References Cited

U.S. PATENT DOCUMENTS

| | | | |
|---|---|---|---|
| 13,577 | 6/1913 | Dooley | 76/104 R |
| 2,448,383 | 8/1948 | Mathaus | 30/357 |
| 2,566,112 | 8/1951 | Barnard | 30/357 |
| 2,636,267 | 4/1953 | Whitcomb | 30/357 |
| 2,651,839 | 9/1963 | Folland | 30/138 |

FOREIGN PATENT DOCUMENTS

| | | | |
|---|---|---|---|
| 451751 | 10/1948 | Canada | 30/357 |
| 1013994 | 8/1957 | Fed. Rep. of Germany | 30/357 |
| 390423 | 4/1933 | Norway | 30/353 |

*Primary Examiner*—Paul A. Bell
*Assistant Examiner*—Paul M. Heyrana, Sr.
*Attorney, Agent, or Firm*—Klarquist, Sparkman, Campbell, Leigh & Whinston

[57] ABSTRACT

A concavely ground knife blade has a pair of side faces characterized by oppositely-directed, continuous, slightly concave surfaces. Such surfaces have an arcuate profile approximately fitting a large (e.g., 30 inch) radius circle and follow essentially straight line axes which gradually bend toward one another to form a point. The side faces are first ground widthwise along a diameter of a grinding wheel having an end face beveled at a shallow angle to form a frustoconical grinding surface. The side faces are then polished lengthwise. The resultant blade has a median thickness in its mid-portion which is nearer the back of the blade than the cutting edge.

8 Claims, 8 Drawing Figures

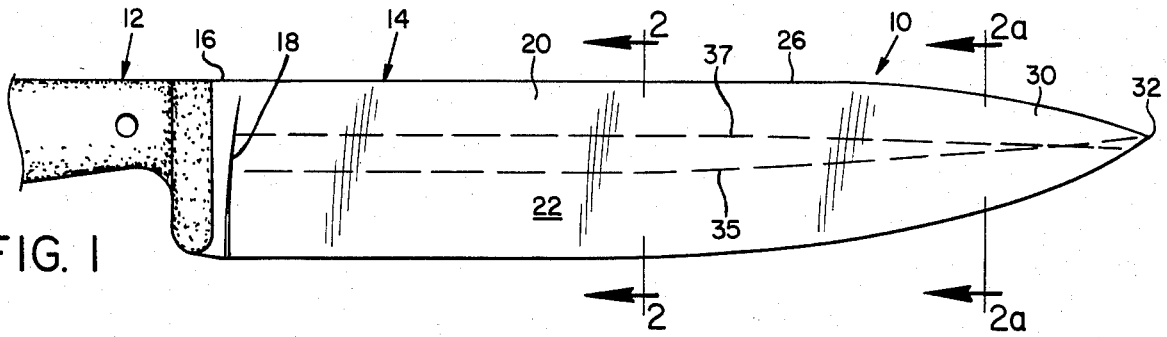
FIG. 1
FIG. 2a
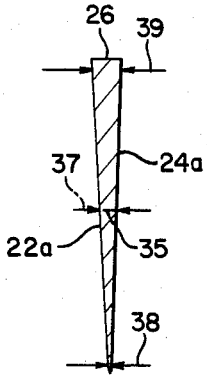
FIG. 2
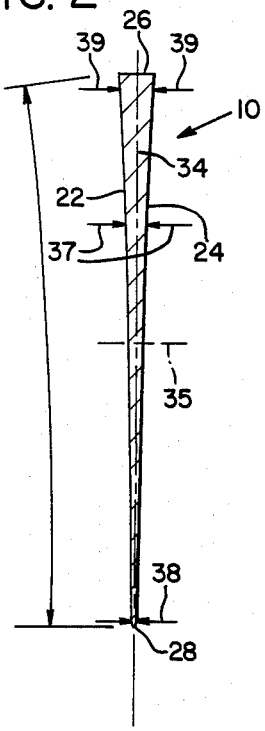
FIG. 3
(PRIOR ART)
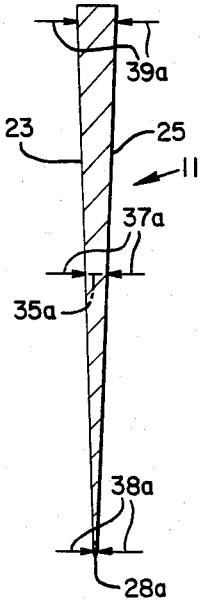
FIG. 4
(PRIOR ART)
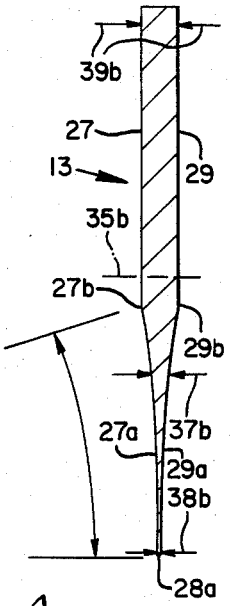
FIG. 5
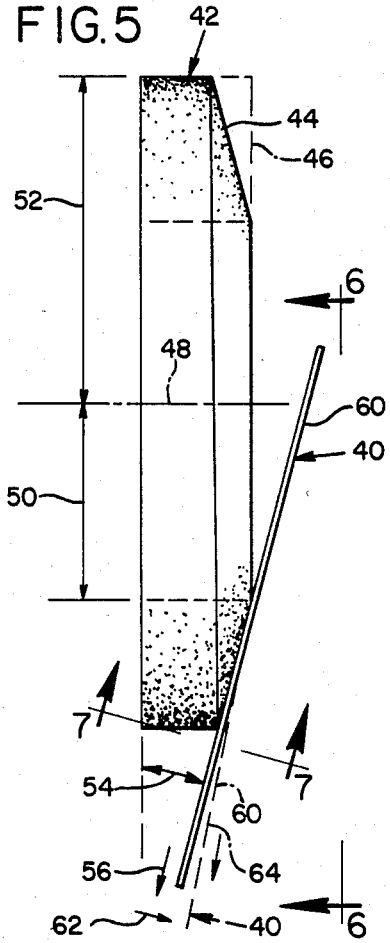
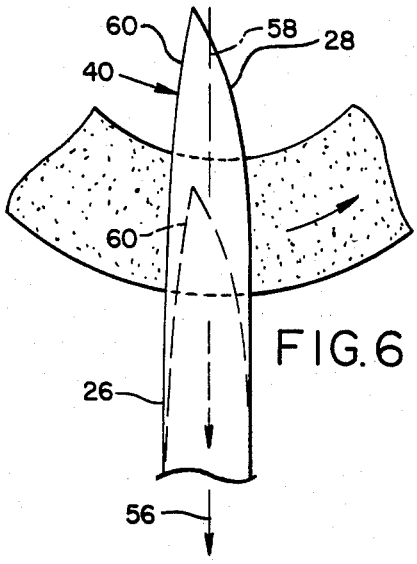
FIG. 6
FIG. 7
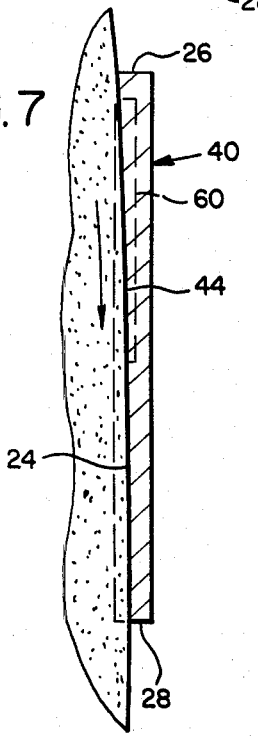

CONCAVE GRIND KNIFE BLADE AND METHOD OF MAKING

BACKGROUND OF THE INVENTION

This invention relates to a configuration of knife blades, particularly the cross-sectional configuration thereof, and to the methods of making such blades.

Several different cross-sectional blade configurations or grinds are commonly used in knives. One well-known configuration is the flat wedge grind, shown in FIG. 3 of the drawing. Among kitchen knives, it is most commonly used in cook's or chef's knives and in boning knives. A blade having a flat wedge grind is characterized by essentially flat side faces tapering toward one another in a V-shaped cross section to form a cutting edge. Another commonly used blade configuration is the hollow grind shown in FIG. 4 of the drawing. Hollow grind blades are characterized by parallel side faces remotely of the cutting edge and a marginal portion, typically about one half inch wide, which is concavely ground on a relatively small radius wheel, for example, 3 inch radius, to form a thin and easily-sharpened cutting edge. This configuration is most commonly used in slicing and utility or paring knives. Conventionally, the axis of the hollow grind follows the curvature of the cutting edge to the point of the blade and is therefore curved in the plane of the blade. A third blade configuration, more commonly used in hunting knives than in kitchen knives, has slightly convex side faces.

The foregoing blade configurations have long been considered satisfactory for various purposes. It is known that hollow grind blades are more easily sharpened than flat wedge or convex grind blades. However, their thin, hollow ground margins quickly wear out with repeated sharpening, limiting the useful lives of such knives. As result, better quality kitchen knives ordinarily employ a flat wedge grind blade configuration, sacrificing ease of sharpening for long useful life.

In the use of conventional kitchen knives, a number of undesirable cutting characteristics have been observed, but largely tolerated or worked around. For example, in slicing cheese, the slices tend to stick to the blades of knives having conventional cross-sectional configurations. In cutting certain types of crisp vegetables, such as carrots, conventional blades tend to slice only part way through the workpiece, thereafter undesirably breaking, without slicing through, the remainder of the workpiece. Very thin knives have been proposed to mitigate the foregoing problems. However, making a kitchen knive very thin sacrifices strength and rigidity, limiting its utility for many cutting and slicing tasks. Resorting to more flexible materials, to avoid breakage, further sacrifices rigidity. It also reduces the hardness of the knife materials, thereby impairing the ability to apply and maintain a very sharp cutting edge. Another result is a proliferation of knife thicknesses in many styles and shapes, which is uneconomical for both the manufacturers and users.

Accordingly, there remains a need for a knife blade configuration that is easily sharpened, yet has a long, useful life, and has the desired cutting characteristics of thin blades, yet has the strength and rigidity of thick blades.

SUMMARY OF THE INVENTION

It is therefore a primary object of the invention to provide a knife with improved cutting characteristics.

A second object of the invention is to provide a knife that may be relatively easily sharpened and have a prolonged useful lifetime through repeated sharpenings.

Another object of the invention as aforesaid is to provide a knife that can cut cheese without sticking.

A further object is to provide a knife capable of cleanly cutting crisp vegetables, slicing through the entire thickness of the vegetable rather than slicing through a portion and breaking the remainder of the thickness.

In accordance with the invention, the foregoing objects are realized in a knife blade configuration wherein the side faces of the blade are defined by slightly concave continuous surfaces over substantially the entire width of the blade.

As a result of the foregoing configuration, the blade can have relatively thin dimensions a considerable distance from the cutting edge, while retaining a stiff spine at the edge face or back of the knife remote from the cutting edge. Such a blade is also lighter in weight than conventional blades of comparable dimensions and materials.

In a preferred embodiment of the invention, the concavity of each side face of the blade is defined by an arc approximately fitting a circle having a radius of 30 inches. Such side faces can be formed by grinding a knife blank widthwise on a frustoconical grinding surface having a radius of, for example, 6 to 8 inches and a base angle of about 15°. In contrast to conventional hollow-ground blades, the concavity of the side faces has an axis extending lengthwise of the blade in a substantially straight line over the entire length of the blade, even if the cutting edge is curved. The blade is also formed with the aforementioned concavity over most of the length of the blade and then gradually flattens out at the point.

The foregoing configuration advantageously provides a blade having the strength and resilience characteristics of a flat wedge knife but the ease of sharpening of a hollow grind knife. The blade of the present invention is also sharpenable to a narrower blade width, without extensive grinding, than either flat wedge or hollow grind blades. That is, as the width of the blade decreases with sharpening, the increase in thickness is less than occurs in either a conventional flat-sided or hollow ground blade of the same initial width.

Another significant advantage of the invention is its superiority to conventional blade configurations in cutting cheese without sticking and in slicing carrots and the like completely through their thickness without breaking the workpiece. Concavely ground knives also compare favorably in very thinly and uniformly slicing materials such as onions.

The foregoing and other objects, features and advantages of the invention will become more readily apparent from the following detailed description of a preferred embodiment which proceeds with reference to the accompanying drawing.

BRIEF DESCRIPTION OF DRAWINGS

FIG. 1 is a side elevational view of a blade of a cook's knife having a concavely ground blade configuration in accordance with the invention.

FIGS. 2 and 2*a* are cross-sectional views taken along lines 2—2 and 2*a*—2*a*, respectively, in FIG. 1.

FIGS. 3 and 4 are cross-sectional views, corresponding to the view of FIG. 2, of prior art flat-wedge grind and hollow grind knives, respectively.

FIG. 5 is a top plan view of a beveled grinding wheel and knife blade blank showing steps in the manufacture of a concave grind blade in accordance with the invention.

FIG. 6 is a side elevational view taken along lines 6—6 in FIG. 5, showing radial orientation of the blade to the wheel during grinding.

FIG. 7 is a view taken along lines 7—7 in FIG. 5 showing the transverse orientation of the knife blade to the grinding surface of the wheel during grinding.

DETAILED DESCRIPTION OF A PREFERRED EMBODIMENT

Blade Configuration

Referring to FIG. 1, a cook's knife 10 has a handle 12 and a concavely ground blade 14 having a tang portion 16 extending into the handle. An arcuate discontinuity line 18 characterizes the transition from the midportion 20 of the blade into the thicker tang 16. Referring to FIG. 2, the blade haas a pair of side faces 22, 24, a back or blunt edge face 26 extending along the top of the blade and a cutting edge 28 extending along the bottom of the blade. Edge face 26 and cutting edge 28 define the width of the blade and they taper or curve toward one another in an end portion 30 of the blade to meet a point 32. The cross section of the blade, seen in FIGS. 2 and 2*a*, is substantially symmetrical about a vertical centerline 34.

The side faces 22, 24 are defined by slightly concave continuous surfaces over the entire width of the blade, excluding, of course, the cutting edge 28, which forms a slightly convex margin when the blade is sharpened. As seen in the cross section of FIG. 2, taken through midportion 20 of the blade, the concavity of the side faces is defined by an arc approximately fitting a circle having a radius of 30 inches. Although approaching circularity, that arc is not precisely circular due to the manner in which the side faces are formed, described hereinafter.

Referring to FIG. 2*a*, the side faces of the blade are gradually inclined toward one another in the end portion 30 of the blade. Concurrently, the concavity of the side faces of the blade gradually transitions into a nonconcave, that is, flat wedge or very slightly convex configuration. Consequently, the tapered end portion has the strength and resilience of comparable flat wedge knives. This feature results from the manner in which the side faces are formed, as described hereinafter. The foregoing proportions are illustrated in an example also described hereinafter.

Referring again to FIGS. 1 and 2, dashed line 35 identifies the widthwise centerline of the blade; that is, the position half way between blunt edge face 26 and cutting edge 28. Dashed line 37 in FIG. 1 topographically indicates the median thickness of the blade along its length. The median thickness, indicated by arrows 37 in FIG. 2, is half of the difference between the thickness of the blade immediately adjacent the cutting edge (at the cutting edge prior to sharpening), indicated by arrows 38, and the thickness at edge face 26, indicated by arrows 39. The corresponding thicknesses are indicated in the prior art knives by arrows 37*a*, 39*a* and arrows 37*b*, 39*b* in FIGS. 3 and 4, respectively.

Referring to FIGS. 3 and 4, the blade configuration of knife 10 can be compared with the prior art blade configurations. FIG. 3 shows a flat wedge grind blade 11, which has essentially flat sides 23, 25 inclined toward one another in a V-shaped cross section to form a cutting edge 28*a*. FIG. 4 shows a hollow grind blade 13 having parallel sides 27, 29 which are hollow ground on a small radius along a marginal portion of their width to form hollow sides 27*a*, 29*a* meeting at a cutting edge 28*a*. The hollow ground and parallel surfaces meet along a discontinuity line 27*b*, 29*b* on each side of blade 13. Dashed lines 35*a* and 35*b* indicate the widthwise centerlines of the prior art blades 11, 13.

Comparing blade 10, 11 and 13, it can be seen that the median thickness of blade 10 is proportionately farther from the cutting edge than in blades 11 and 13. Referring to FIGS. 1, 2 and 2*a*, line 37 is above centerline 35 along most of the length of blade 10, such lines only converging, and finally meeting, in end portion 30. In the midportion 30 of knife 10, which does most of the cutting, the median thickness is at a distance of about 60% of the width of the blade from cutting edge 28, when the blade is new. In contrast, the median thickness 37*a* of a flat wedge grind blade 11 (FIG. 3) coincides with its centerline 35*a* over its entire length. The median thickness 37*b* of a hollow grind blade 13 (FIG. 4) is below centerline 35*b*, closer to the cutting edge 28*b* than to edge face 39*b*, and follows the curvature of the cutting edge. With repeated sharpening of each blade until the cutting edge is located at the median thickness line, blade 10 provides the greatest sharpenable width, and, therefore, the longest usable lifetime, without having to grind away substantial amounts of metal to maintain a sharp cutting edge.

Example: Eight-Inch Cook's Knife

Without limitation of the invention, following is an example of an 8 inch cook's knife embodying the invention. Such a knife has generally the same shape as the knife shown in FIGS. 1, 2 and 2*a*. Its length from line 18 to point 32 is $8\frac{1}{4}$ inches. Its width at the lengthwise midpoint of the blade (line 2—2) is $1\frac{1}{2}$ inches and at $1\frac{1}{2}$ inches from point 32 (line 2*a*—2*a*) is 1 inch. Referring to FIG. 2, thicknesses 35, 38 and 39 at lines 2—2 and 2*a*—2*a* are approximately as follows:

TABLE I

| Reference Number | (In Inches) FIG. 2 | FIG. 2a |
|---|---|---|
| 38 | .015 | .015 |
| 35 | .040 | .038 |
| 39 | .080 | .060 |

At line 2—2, the median thickness line 37 of the blade is 31/32 inch, or about 59.5% of the blade's width, from the cutting edge. At line 2*a*—2*a*, the median thickness line 37 is positioned approximately equidistantly between the cutting edge 28 and edge face 26, consistent with the blade being flat to very slightly convex in end portion 30.

Method of Making

Referring to FIG. 5, the concave configuration of the side faces 22, 24 is obtained by grinding a knife blank 40 on a universal grinding wheel 42 having a beveled end face 44. In the manufacture of flat wedge grind knives in accordance with the prior art, the flat side faces are formed by grinding a knife blank on a grinding wheel having a nonbeveled end face 46 perpendicular to the rotational axis 48 of the wheel. The present invention employs an annular grinding wheel having an inner radius of 50 and an outer radius 52 and an end face beveled about a base angle 54. The precise dimensions of the inner and outer radii and the base angle can be varied but, to produce the preferred concavity of the side faces, should jointly form a frustoconical (frustum-shaped conical) surface having an arcuate profile, best seen in FIG. 7, approximately fitting a circle having a radius of 30 inches. A suitable wheel configuration has an inner radius 50 of 6 inches, an outer radius 52 of 8 inches and a bevel or base angle 54 of 15°.

In the manufacture of knife 10, knife blank 40 is ground first on one side to form side face 24 and then on the other side to form face 22. The knife blank 40 is positioned in a conventional sliding rack (not shown) which draws the blank approximately radially of wheel 42 parallel to face 44 in the direction of arrow 56 to form side face 24 in the body of the blade in accordance with the profile of surface 44. The blank is centered along a diameter 58 of the wheel and tilted slightly toward the wheel along one edge to grind cutting edge 28 to a lesser thickness than edge face 26. The blank is then drawn radially along surface 44 while the wheel turns to grind side face 24 concavely in a widthwise direction. As the end portion 60 of the blank approaches grinding surface 44, as shown in dashed lines in FIGS. 5 and 6, conventional camming means (not shown) engages the sliding rack gradually to pivot the blank transversely, as indicated by arrow 62, toward a plane perpendicular to axis 48, portion 60 remaining in grinding contact with surface. At the same time, the knife blank continues to be moved along diameter 58, as indicated by arrow 64, to taper the thickness of end portion 60 gradually to a point. In this way, the blank is concavely ground along an axis which is essentially a straight line extending lengthwise of the side faces of the blade, except that such line bends very gradually toward the blade proceeding into end portion 60.

This step completes the rough grinding of concave face 24. Face 22 is formed in like manner on a grinding machine set up so as to form essentially a mirror image of face 24.

Following rough grinding, the side faces are ground lengthwise, using, for example, a 320 grit abrasive compound, between cotton buffs to obliterate the widthwise grinding scratches produced during rough grinding and thereby partially polish the blade. Next, the blade is finish polished using soft buffs and a conventional fine polishing compound. These polishing steps tend to reduce slightly the concavity of the sides of the blade, flattening them in end portion 30, as shown in FIG. 2*a*. Finally, handle 12 is mounted on the tang 16 of the blade and cutting edge 28 is sharpened.

The foregoing configuration and method of producing same are applicable to a wide variety of knives, including cook's knives, slicers, utility knives and boning knives. The precise curvatures employed may vary from one configuration of knife to another and, to some extent, within a given type of knife due, for example, to variations in manufacturing tolerances. However, all such knives will have in common a large radius concave transverse blade profile.

While slight, the resultant concavity of the side faces of the blade of the invention can be ascertained generally by comparing the sizes of images of a distant object reflected from a polished blade held at different distances from the viewer and can be measured using, for example, a diffraction technique described in U.S. Pat. No. 2,867,149 to Goddard. A finished but unsharpened blade in accordance with the invention as a median thickness closer to its blunt edge face than its cutting edge, preferably at about 60% of the width of the blade from the cutting edge in a lengthwise midportion of the blade, where most of the cutting is done.

Having illustrated and described the principles of my invention in a preferred embodiment, it should be apparent to those skilled in the art that the invention can be modified in arrangement and detail without departing from its principles. I claim as my invention all such modifications as come within the spirit and scope of the following claims.

I claim:

1. An improved knife blade configuration wherein the blade comprises a pair of opposite side faces, a blunt edge and a sharpened cutting edge, the surface of each side face from said blunt edge to said sharpened cutting edge in a longitudinal mid-portion of the blade being slightly concave about a large, single radius of constant curvature, the blade having a median thickness substantially nearer the blunt edge than the cutting edge over a substantial portion of the length of the blade, the side faces being substantially parallel immediately above the sharpened cutting edge.

2. A blade configuration according to claim 1 in which the concavity of the side faces is defined by an arc approximately fitting a circle having a radius of 30 inches.

3. A blade configuration according to claim 1 in which the side faces are formed in accordance with an angular segment of a frustoconical surface having a radius of at least 6 inches and a base angle of about 15°.

4. A blade configuration according to claim 3 in which said radius is 8 inches.

5. A knife according to claim 1 in which the median thickness is spaced from the cutting edge about 60% of the width of the blade along a midsection of the blade.

6. A blade configuration according to claim 1 in which the side faces are formed about an axis of concavity extending lengthwise of the blade in a substantially straight line over the entire length of the blade, the cutting edge of the blade being curved.

7. A blade configuration according to claim 6 in which the blade has an end tapering to a point at which the blunt edge face and cutting edge meet, the side faces of the blade being gradually inclined toward one another proceeding toward said point.

8. A blade configuration according to claim 6 in which the side faces have, in a region adjacent the point, a nonconcave configuration, said axis being gradually inclined toward the center of the blade but otherwise being a straight line.

* * * * *